US010149590B2

(12) United States Patent
Jeong et al.

(10) Patent No.: US 10,149,590 B2
(45) Date of Patent: Dec. 11, 2018

(54) ROBOT CLEANER

(71) Applicant: SAMSUNG ELECTRONICS CO., LTD., Suwon-si, Gyeonggi-do (KR)

(72) Inventors: Jae Youl Jeong, Suwon-si (KR); Sung Jin Park, Suwon-si (KR); Heum Yong Park, Suwon-si (KR); Dong Hun Lee, Ansan-si (KR); Min Jae Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 732 days.

(21) Appl. No.: 14/497,671

(22) Filed: Sep. 26, 2014

(65) Prior Publication Data

US 2015/0143646 A1 May 28, 2015

(30) Foreign Application Priority Data

Nov. 25, 2013 (KR) ..... 10-2013-0143931

(51) Int. Cl.
*A47L 11/40* (2006.01)
*A47L 11/283* (2006.01)

(52) U.S. Cl.
CPC ..... *A47L 11/4036* (2013.01); *A47L 11/283* (2013.01); *A47L 11/4038* (2013.01);
(Continued)

(58) Field of Classification Search
CPC .... A47L 11/03; A47L 11/283; A47L 11/4011; A47L 11/4036; A47L 11/4038;
(Continued)

(56) References Cited

U.S. PATENT DOCUMENTS 1,442,217 A * 1/1923 H'Doubler ..... F16H 3/34 310/83
1,461,181 A * 7/1923 Dick ..... B61D 43/00 105/102

(Continued)

FOREIGN PATENT DOCUMENTS

DE 10000407 A1 * 7/2001 ..... A47L 5/30
DE 10 2011 004 319 8/2012

(Continued)

OTHER PUBLICATIONS

European Search Report dated Mar. 25, 2015 in corresponding European Patent Application No. 14194381.1

(Continued)

*Primary Examiner* — Joseph J Hail
*Assistant Examiner* — Arman Milanian
(74) *Attorney, Agent, or Firm* — Staas & Halsey LLP

(57) ABSTRACT

A robot cleaner includes a plurality of motors each of which transmits a driving force, a pad assembly which is connected to one of the plurality of motors to receive a rotational force from the motor, to rotate in a clockwise or counterclockwise direction, and thus to clean a floor surface, and a wire which is connected to the pad assembly and another one of the plurality of motors so that the pad assembly is tilted by the driving force of the motor, wherein the robot cleaner moves in a particular direction by a non-uniform frictional force between a bottom surface of the pad assembly and the floor surface. The robot cleaner uses wires to tilt the pad assembly and, thus, it is possible to miniaturize the robot cleaner.

21 Claims, 10 Drawing Sheets

(52) U.S. Cl.
CPC ..... *A47L 11/4061* (2013.01); *A47L 11/4066* (2013.01); *A47L 11/4069* (2013.01); *A47L 11/4088* (2013.01); *A47L 2201/04* (2013.01)

(58) Field of Classification Search
CPC ..... A47L 11/4061; A47L 11/4066; A47L 11/4069; A47L 11/408; A47L 11/4088; A47L 2201/00; A47L 2201/04; B25J 17/00; B25J 9/0003; B25J 9/10; B25J 5/007
USPC ..... 180/7.1; 318/568.11
See application file for complete search history.

(56) References Cited

U.S. PATENT DOCUMENTS 1,839,824 A * 1/1932 Zucker ..... A47L 11/12 15/50.1
1,931,893 A * 10/1933 Fleming ..... B60S 3/048 15/29
2,978,719 A * 4/1961 Arones ..... A47L 11/16 15/320
2,999,554 A * 9/1961 Wagner ..... B62D 57/00 180/6.48
3,212,594 A * 10/1965 Scott ..... B60B 19/00 180/10
3,251,430 A * 5/1966 Veryzer ..... B60V 3/025 180/119
3,714,423 A * 1/1973 Lucas ..... H01J 37/20 250/311
3,985,047 A * 10/1976 Therkelsen ..... B66D 1/14 254/354
4,004,780 A * 1/1977 Kuzarov ..... B66D 1/16 254/345
4,149,294 A * 4/1979 MacKay, Jr. ..... B24D 13/145 15/230.12
4,411,329 A * 10/1983 Stedman ..... B62D 57/00 180/257
4,519,466 A * 5/1985 Shiraishi ..... B60B 19/00 180/252
4,666,362 A * 5/1987 Landsberger ..... B25J 17/0266 212/239
4,701,970 A * 10/1987 Wilson ..... A47L 11/164 15/230.16
4,719,659 A * 1/1988 Urakami ..... A47L 11/16 15/49.1
4,747,176 A * 5/1988 Parks ..... A47L 11/164 15/230.16
4,795,867 A * 1/1989 Ohi ..... B60H 1/00814 200/11 DA
4,881,288 A * 11/1989 May ..... A47L 11/1625 134/6
5,279,672 A * 1/1994 Betker ..... A47L 11/305 134/18
5,309,592 A * 5/1994 Hiratsuka ..... A47L 11/4011 15/319
5,636,402 A * 6/1997 Kubo ..... A47L 11/03 15/319
5,815,880 A 10/1998 Nakanishi
5,991,951 A * 11/1999 Kubo ..... A47L 11/16 15/340.4
6,185,776 B1 * 2/2001 Windmeisser ..... A47L 11/164 15/49.1
6,585,827 B2 * 7/2003 Field ..... A47L 11/03 134/21
6,809,495 B2 * 10/2004 Rodnunsky ..... B66C 13/08 104/180
7,172,385 B2 * 2/2007 Khajepour ..... B25J 17/0266 414/735
7,241,210 B2 * 7/2007 Van Vliet ..... A47L 11/16 451/353
2001/0004719 A1 * 6/2001 Sommer ..... A47L 5/30 701/23
2004/0049878 A1 * 3/2004 Thomas, Sr. ..... A47L 11/14 15/320
2012/0118319 A1 * 5/2012 Stuchlik ..... A47L 11/293 134/6
2013/0164107 A1 * 6/2013 Pehlivan ..... B25J 17/0266 414/732
2014/0083287 A1 * 3/2014 Peguero ..... A47L 11/26 91/218
2014/0127975 A1 * 5/2014 Roy ..... A47L 11/16 451/28
2014/0196231 A1 * 7/2014 Park ..... A47L 11/4066 15/98
2015/0142169 A1 * 5/2015 Kim ..... A47L 11/282 700/245

FOREIGN PATENT DOCUMENTS

DE 102011004319 A1 * 8/2012 ..... A47L 11/24
FR 2876018 A1 * 4/2006 ..... A47L 11/164
JP H09299298 A * 11/1997 ..... A47L 11/16
JP 09325814 A * 12/1997 ..... A47L 11/16
JP 11077577 A * 3/1999 ..... B25J 9/0078
KR 20080091042 A * 10/2008 ..... A47L 11/28
WO WO 02085176 A1 * 10/2002 ..... A47L 11/292
WO WO 03013944 A2 * 2/2003 ..... A47L 1/02
WO WO 2012/086604 6/2012
WO WO2012086604 * 6/2012 ..... A47L 11/16
WO WO 2012086604 A1 * 6/2012 ..... A47L 11/283

OTHER PUBLICATIONS

Decision on Grant dated Aug. 3, 2016 in corresponding European Patent Application No. 14 194 381.1.

* cited by examiner

ROBOT CLEANER

CROSS-REFERENCE TO RELATED APPLICATIONS

This application claims the benefit of Korean Patent Application No. 10-2013-0143931, filed on Nov. 25, 2013 in the Korean Intellectual Property Office, the disclosure of which is incorporated herein by reference.

BACKGROUND

1. Field

One or more embodiments relate to a robot cleaner which may move through a non-uniform frictional force between a pad and a floor surface.

2. Description of the Related Art

A robot cleaner is an apparatus which may move in an area to be cleaned by itself without an operation of a user and perform a cleaning operation by sucking foreign substances such as dust from a floor surface. The robot cleaner discriminates distances to obstacles, such as furniture, office appliances, and walls, which are disposed in the area to be cleaned, through a distance sensor, and selectively drives a left wheel motor and a right wheel motor of the robot cleaner to change a direction, and performs the cleaning operation on the area to be cleaned.

Recently, a new robot cleaner which wipes dust from the floor surface as well as the robot cleaner which sucks the foreign substances such as dust from the floor surface is being released. In a conventional robot cleaner, a pad is provided at a bottom surface thereof, and the pad is in contact with the floor surface when the robot cleaner moves, and thus wipes the floor surface. At this time, the robot cleaner moves using a separate moving means.

SUMMARY

The foregoing described problems may be overcome and/or other aspects may be achieved by one or more embodiments of a robot cleaner which may move in various directions using a non-uniform frictional force between a pad and a floor surface, and may reduce a load applied to a driving source.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a robot cleaner may include a plurality of motors configured to transmit a driving force, a pad assembly connected to one of the plurality of motors to receive a rotational force from the motor and configured to rotate in a clockwise or counterclockwise direction to clean a floor surface, and a wire connected to the pad assembly and another one of the plurality of motors so that the pad assembly is tilted by the driving force of the motor, wherein the robot cleaner moves in a particular direction by a non-uniform frictional force between a bottom surface of the pad assembly and the floor surface.

The wire may include a first wire which tilts the pad assembly with respect to an x-axis and a second wire which tilts the pad assembly with respect to a y-axis.

The plurality of motors may include a first motor connected with the first wire, a second motor connected with the second wire, and a third motor configured to rotate the pad assembly around a z-axis in the clockwise or counterclockwise direction.

The first wire may be installed at a first shaft connected to the first motor to be rotated, and the second wire may be installed at a second shaft connected to the second motor to be rotated.

The first shaft may include a first driving shaft connected with the first motor and a first connection shaft geared with the first driving shaft.

The first wire may include a portion configured to connect the first driving shaft and one side of the pad assembly and a portion configured to connect the second connection shaft and the other side of the pad assembly which is opposite to the one side the pad assembly.

The pad assembly may include a rotational plate rotated in the clockwise or counterclockwise direction by the third motor.

The pad assembly may include an elastic member assembly installed at a bottom surface of the rotational plate and a pad unit installed at a bottom surface of the elastic member assembly.

The elastic member assembly may include an elastic body configured to adapt an entire bottom surface of the pad assembly to be in contact with the floor surface and an elastic member receiving part in which the elastic body is received.

The elastic member receiving part may be formed as a flexible tube having a plurality of wrinkles and formed of a rubber material.

The pad unit may include a pad installation part removably installed at a bottom surface of the elastic member receiving part and a pad removably installed at the pad installation part to clean the floor surface.

The rotational plate may have a connection part through which water is supplied from a water tank, and the elastic member assembly and the pad unit may have a water supplying hole in communication with the connection part.

A water supplying member may be installed at the rotational plate, and the water supplying member may include a central hole in communication with the connection part and a side hole formed at a side surface thereof to be in communication with the central hole.

The water supplied through the connection part may be sprayed through the side hole of the water supplying member.

The pad assembly may be provided in plural, and each pad assembly may be driven independently.

In accordance with one or more embodiments, a robot cleaner may include a pad assembly installed at a base and having a pad installed at a bottom surface thereof, a first motor and a second motor which are provided at the base, a third motor connected with the pad assembly to rotate the pad assembly in a clockwise or counterclockwise direction, a first wire connected with the pad assembly and the first motor to tilt the pad assembly with respect to an x-axis, and a second wire connected with the pad assembly and the second motor to tilt the pad assembly with respect to a y-axis, wherein, when the pad assembly is tilted by the first wire or the second wire, the robot cleaner moves in a particular direction by a non-uniform frictional force between the bottom surface of the pad assembly and a floor surface.

A moving direction may be determined by a position having a large frictional force between the bottom surface of the pad assembly and the floor surface and a rotational direction by the third motor.

The first wire may be installed at a first shaft connected to the first motor to be rotated, and the second wire may be installed at a second shaft connected to the second motor to be rotated.

The pad assembly may include an elastic body configured to adapt an entire surface of the pad to be in contact with the floor surface.

The elastic body may be received in a flexible tube having a plurality of wrinkles and formed of a rubber material.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
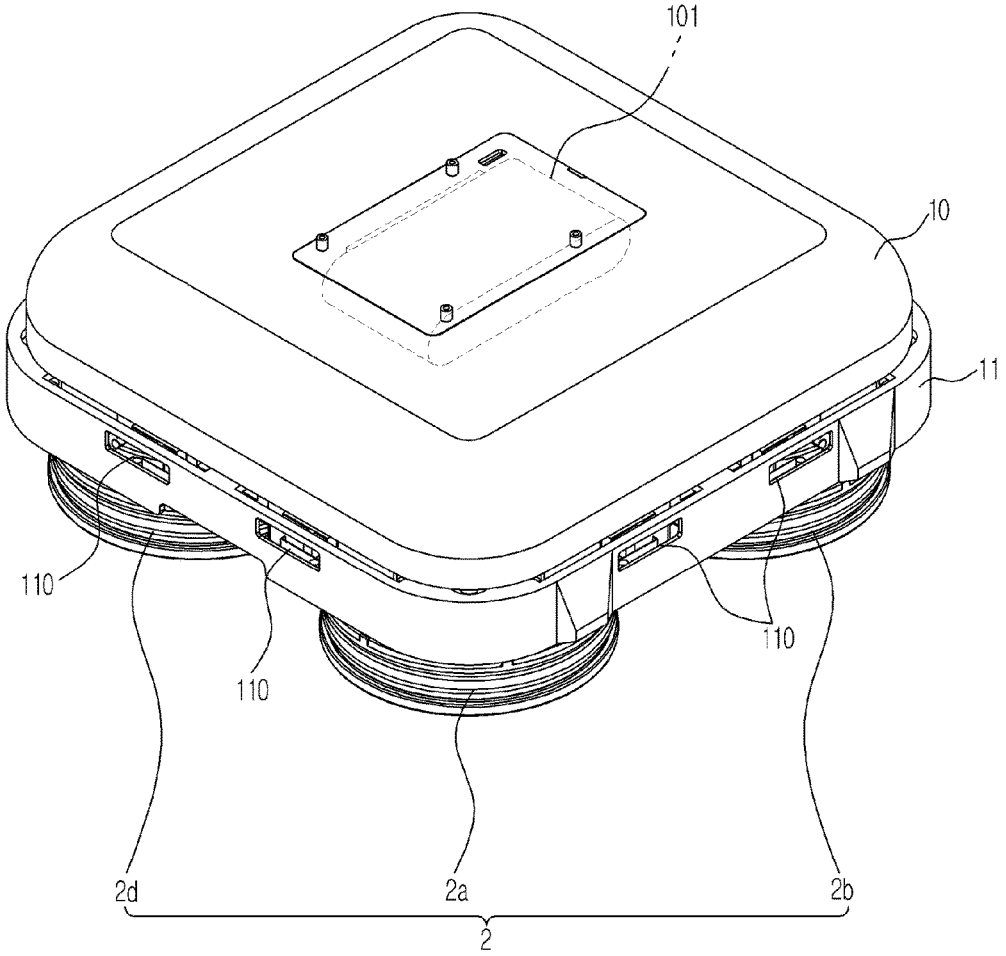
FIG. 1 is a perspective view of a robot cleaner in accordance with one or more embodiment.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Figure 2:
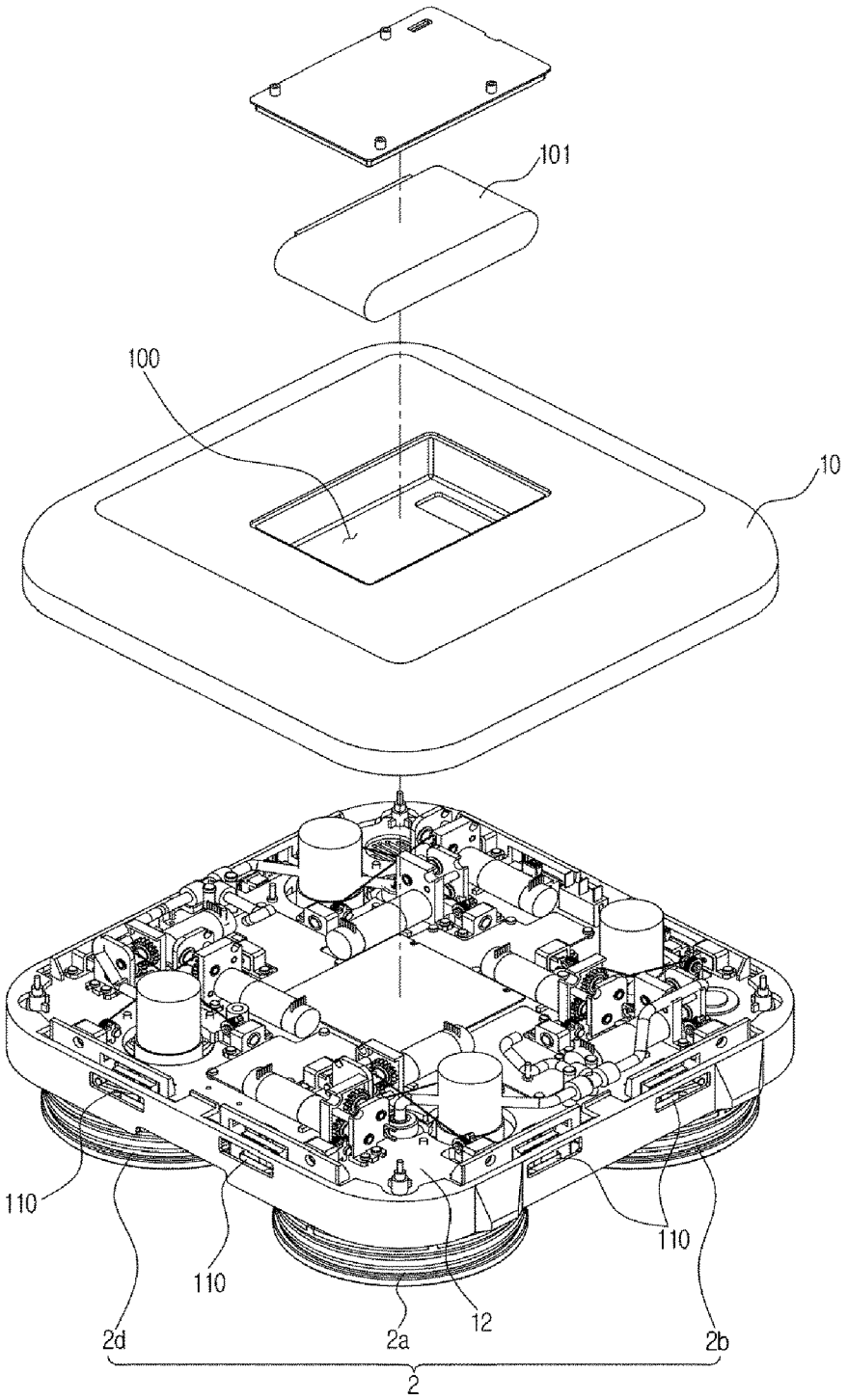
FIG. 2 is a view illustrating a state in which a cover of a robot cleaner is removed in accordance with one or more embodiment.
Figure 3:
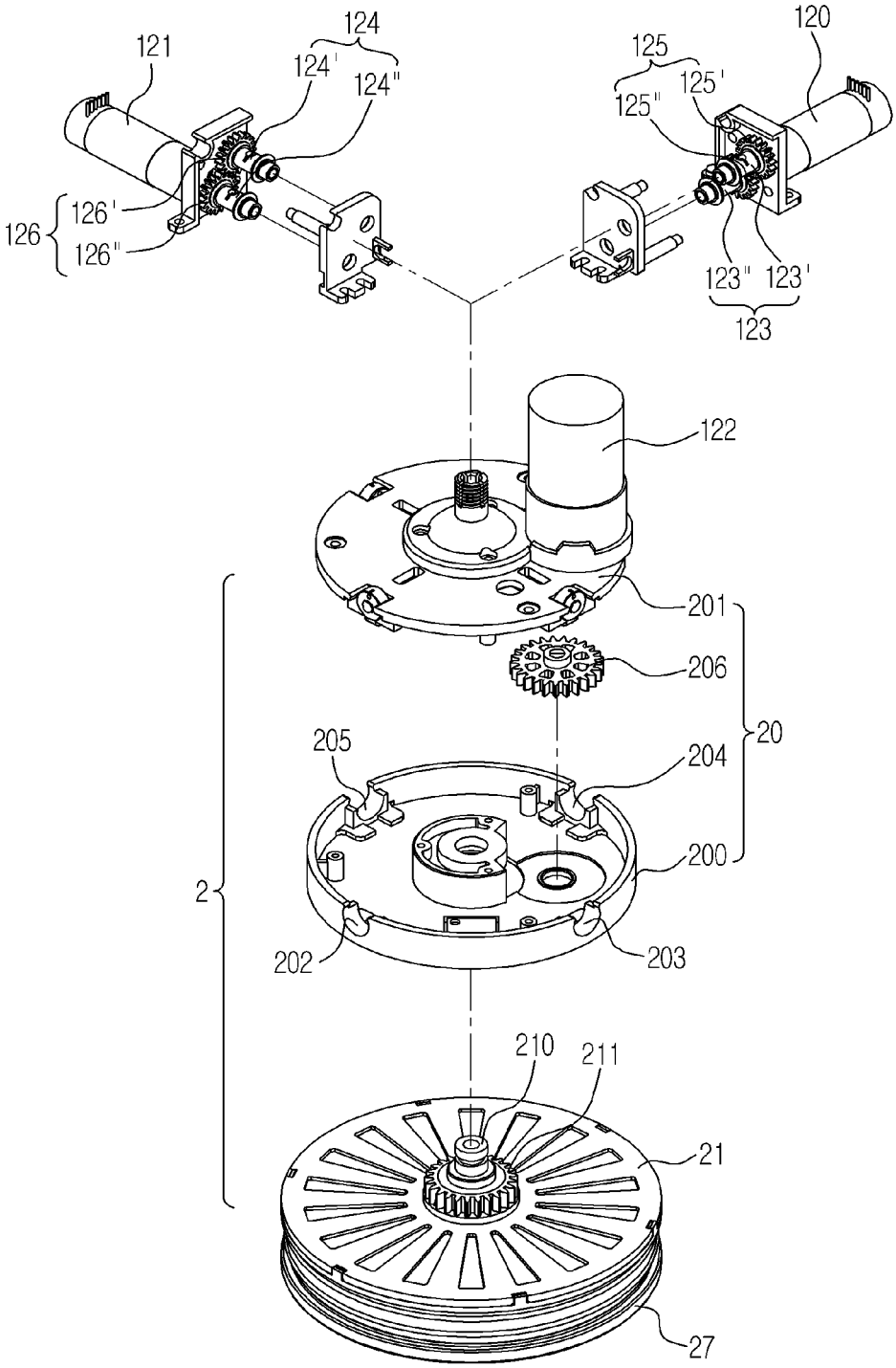
FIG. 3 is an exploded perspective view partially illustrating a robot cleaner in accordance with one or more embodiment.
Figure 4A:
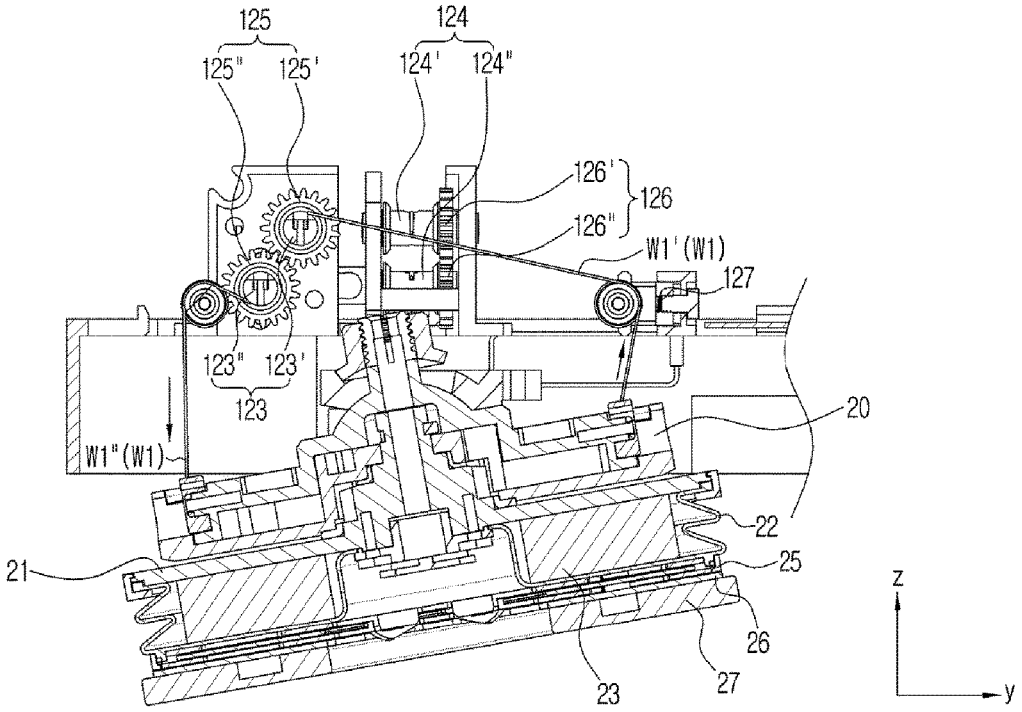
FIGS. 4A and 4B are cross-sectional views partially illustrating a robot cleaner in accordance with one or more embodiment.
Figure 4B:
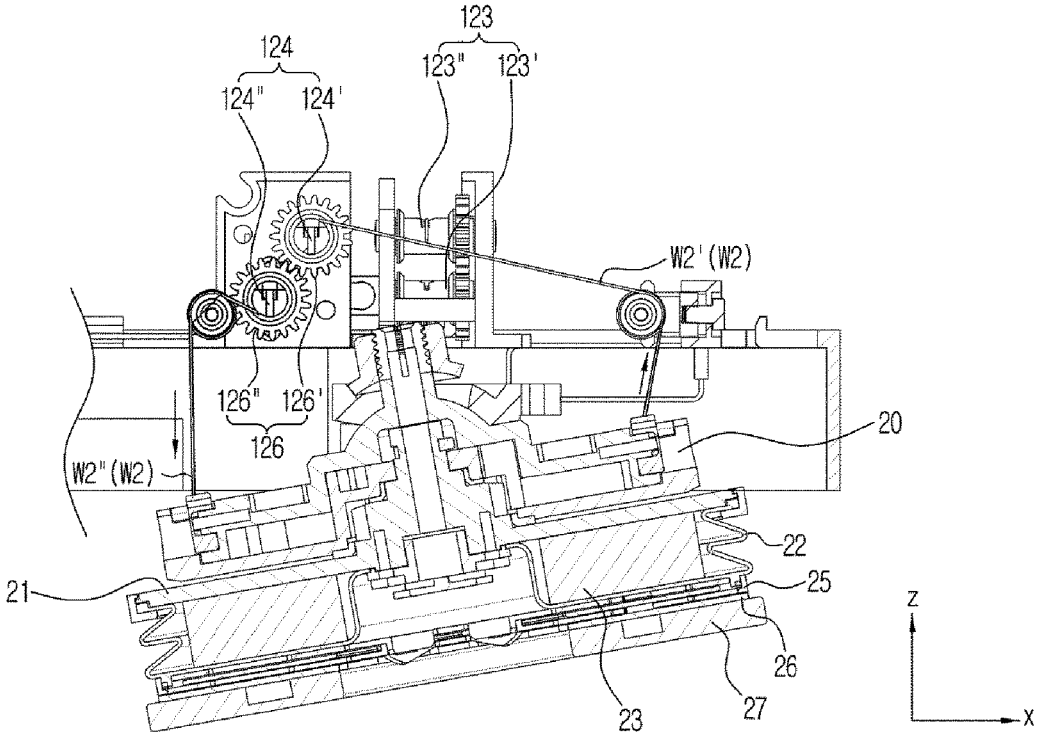

FIG. 1 is a perspective view of a robot cleaner in accordance with one or more embodiment, FIG. 2 is a view illustrating a state in which a cover of a robot cleaner is removed in accordance with one or more embodiment, FIG. 3 is an exploded perspective view partially illustrating a robot cleaner in accordance with one or more embodiment, and FIGS. 4A and 4B are cross-sectional views partially illustrating a robot cleaner in accordance with one or more embodiment.

Referring to FIGS. 1 to 4B, a robot cleaner 1 in accordance with one or more embodiment may include a plurality of pad assemblies 2. A pad 27 may be installed at a bottom surface of the pad assembly 2. A floor surface may be wet-cleaned by the pad 27. The pad assembly 2 may scrub the floor surface. The robot cleaner 1 may move in various directions using a non-uniform frictional force between the pad assembly 2 and the floor surface.

An upper portion of the robot cleaner 1 may be covered by a cover 10. A water tank receiving portion 100 may be provided at one side of the cover 10. A water tank 101 may be received in the water tank receiving portion 100. Water stored in the water tank 101 may be supplied to the pad assembly 2 through a water supplying tube (not shown). The pad assembly 2 may receive the water from the water tank 101 and wet-clean the floor surface. A bumper 11 may be provided at each side surface of the robot cleaner 1. A shock applied from an external obstacle to the robot cleaner 1 may be cushioned by the bumper 11.

A sensor 110 may be provided at one side of the bumper 11. The sensor 110 may include an obstacle detecting sensor, a position detecting sensor, and so on. An obstacle located at a front side of the robot cleaner 1 may be detected by the sensor 110. The sensor 110 may communicate with a sensor provided at a docking station or a pad replacing device, and guide the robot cleaner 1 to the docking station or the pad replacing device.

The pad assembly 2 may be installed at a base 12, and the plurality of pad assemblies 2 may be provided. Hereinafter, one or more embodiment in which the pad assembly 2 may include a first pad assembly 2*a*, a second pad assembly 2*b*, a third pad assembly 2*c*, and a fourth pad assembly 2*d* will be described (see FIG. 5*a*). Since the first pad assembly 2*a*, the second pad assembly 2*b*, the third pad assembly 2*c*, and the fourth pad assembly 2*d* may have the same configuration, the pad assembly 2 means at least one of the first pad assembly 2*a*, the second pad assembly 2*b*, the third pad assembly 2*c*, and the fourth pad assembly 2*d*.

The pad assembly 2 may be driven by a motor. The motor may include a first motor 120, a second motor 121, and a third motor 122. The first and second motors 120 and 121 may be disposed at the base 12, and the third motor 122 may be installed at the pad assembly 2. The pad assembly 2 may scrub the floor surface while being rotated by the third motor 122.

A first shaft 123 may be connected to the first motor 120. The first shaft 123 may be rotated by the first motor 120. A first wire W1 may be connected to the first shaft 123. When the first shaft 123 is rotated in a clockwise or counterclockwise direction by the first motor 120, the first wire W1 may be wound on the first shaft 123.

One end or the other end of the first wire W1 may be fixed to the pad assembly 2. When the first shaft 123 is rotated and the first wire W1 is wound on the first shaft 123, the pad assembly 2 may be tilted by the first wire W1.

As an example, when the first shaft 123 is rotated and the first wire W1 is wound on the first shaft 123, the pad assembly 2 may be tilted with respect to an x-axis by the first wire W1. If the pad assembly 2 is tilted and the pad assembly 2 is rotated around a z-axis by the third motor 122, a non-uniform frictional force may be generated between a bottom surface of the pad assembly 2 and the floor surface.

Only one first shaft 123 may be provided and the first wire W1 may be fixed thereto. The first shaft 123 may include a first driving shaft 123' connected with the first motor 120 and a first connection shaft 123". The first driving shaft 123' and the first connection shaft 123" may be connected through a gear 125. The first driving shaft 123' may have a first driving gear 125', and the first connection shaft 123" may have a first connection gear 125". The first driving gear 125' and the first connection gear 125" may be engaged with each other.

When a driving force of the first motor 120 is transmitted to the first driving shaft 123', the first connection shaft 123" may be rotated together with the first driving shaft 123' through the gear connection. The first driving shaft 123' and the first connection shaft 123" may be rotated in opposite directions to each other. For example, if the first driving shaft 123' is rotated in the clockwise direction, the first connection shaft 123" may be rotated in the counterclockwise direction.

Two first wires W1' and W1" may be provided, and one end of one of the first wires W1' may be fixed to the first driving shaft 123' and the other end thereof may be fixed to one side of the pad assembly 2, and one end of the other first wire W1" may be fixed to the first connection shaft 123" and the other end thereof may be fixed to the other side of the pad assembly 2. If one of the wire W1' connected to the first driving shaft 123' and the wire W1" connected to the first connection shaft 123" is wound on the corresponding shaft, the other one may be released from the other corresponding shaft.

For example, if the first wire W1' connected to the first driving shaft 123' lifts up one side of the pad assembly 2, the first wire W1" connected to the first connection shaft 123" lifts down the other side of the pad assembly 2 so that the bottom surface of the other side of the pad assembly 2 may be closer to the floor surface. Therefore, the bottom surface of the other side of the pad assembly 2 may be tilted with respect to the x-axis. When the pad assembly 2 is rotated around the z-axis by the third motor 122, the frictional force between the pad assembly 2 and the floor surface may be generated non-uniformly.

A second shaft 124 may be connected to the second motor 121. The second shaft 124 may be rotated by the second motor 121. A second wire W2 may be connected to the second shaft 124. When the second shaft 124 is rotated in the clockwise or counterclockwise direction by the second motor 121, the second wire W2 may be wound on the second shaft 124. A straight line passing through from the pad assembly 2 to a position at which the second wire W2 is installed may be perpendicular to a straight line passing through from the pad assembly 2 to a position at which the first wire W1 is installed.

One end and/or the other end of the second wire W2 may be fixed to the pad assembly 2. When the second shaft 124 is rotated and the second wire W2 is wound on the second shaft 124, the pad assembly 2 may be tilted by the second wire W2.

As an example, when the second shaft 124 is rotated and the second wire W2 is wound on the second shaft 124, the pad assembly 2 may be tilted with respect to a y-axis by the second wire W2. If the pad assembly 2 is tilted and the pad assembly 2 is rotated around the z-axis by the third motor 122, the non-uniform frictional force may be generated between the bottom surface of the pad assembly 2 and the floor surface.

Only one second shaft 124 may be provided and the second wire W2 may be fixed thereto. Like in the first shaft 123, the second shaft 124 may include a second driving shaft 124' connected with the second motor 121 and a second connection shaft 124". The second driving shaft 124' and the second connection shaft 124" may be connected through a gear 126. The second driving shaft 124' may have a third driving gear 126', and the second connection shaft 124" may have a fourth connection gear 126". The third driving gear 126' and the fourth connection gear 126" may be engaged with each other.

When a driving force of the second motor 121 is transmitted to the second driving shaft 124', the second connection shaft 124" may be rotated together with the second driving shaft 124' through the gear connection. The second driving shaft 124' and the second connection shaft 124" may be rotated in opposite directions to each other. For example, if the second driving shaft 124' is rotated in the clockwise direction, the second connection shaft 124" may be rotated in the counterclockwise direction.

Two second wires W2' and W2" may be provided, and one end of one of the second wires W2' may be fixed to the second driving shaft 124' and the other end thereof may be fixed to one side of the pad assembly 2, and one end of the other second wire W2" may be fixed to the second connection shaft 124" and the other end thereof may be fixed to the other side of the pad assembly 2. If one of the wire W2' connected to the second driving shaft 124' and the wire W2" connected to the second connection shaft 124" is wound on the corresponding shaft, the other one may be released from the other corresponding shaft. For example, if the second wire W2' connected to the second driving shaft 124' lifts up one side of the pad assembly 2, the second wire W2" connected to the second connection shaft 124" lifts down the other side of the pad assembly 2 so that the bottom surface of the other side of the pad assembly 2 may be closer to the floor surface. Therefore, the bottom surface of the other side of the pad assembly 2 may be tilted with respect to the y-axis. When the pad assembly 2 is rotated around the z-axis by the third motor 122, the frictional force between the pad assembly 2 and the floor surface may be generated non-uniformly.

Since the pad assembly 2 is tilted by the first motor 120 or the second motor 121, and also rotated in the clockwise or counterclockwise direction by the third motor 122, the robot cleaner 1 may move in a particular direction, while the floor surface is cleaned by the pad assembly 2.

That is, the first pad assembly 2*a*, the second pad assembly 2*b*, the third pad assembly 2*c*, or the fourth pad assembly 2*d* may be connected with the separate first or second motor. The first pad assembly 2*a*, the second pad assembly 2*b*, the third pad assembly 2*c*, or the fourth pad assembly 2*d* may be tilted with respect to the x or y axis by the first motor or the second motor. Further, the first pad assembly 2*a*, the second pad assembly 2*b*, the third pad assembly 2*c*, or the fourth pad assembly 2*d* each may include a separate third motor. The first pad assembly 2*a*, the second pad assembly 2*b*, the third pad assembly 2*c*, or the fourth pad assembly 2*d* may be rotated in the clockwise or counterclockwise direction by the third motor to scrub the floor surface.

The first motor 120 and the second motor 121 which may tilt the first pad assembly 2*a*, the second pad assembly 2*b*, the third pad assembly 2*c*, or the fourth pad assembly 2*d* may be provided at the base 12. The third motor 122 which may rotate the first pad assembly 2*a*, the second pad assembly 2*b*, the third pad assembly 2*c*, or the fourth pad assembly 2*d* around the z-axis in the clockwise or counterclockwise direction may be installed at each of the first pad assembly 2*a*, the second pad assembly 2*b*, the third pad assembly 2*c*, and the fourth pad assembly 2*d*.

Meanwhile, the first wire W1 and second wire W2 may be steel wires. A tensile force of the first wire W1 may be controlled by a tension control device 127. As an example, the first wire W1 may be provided to be wound on the tension control device 127. The tensile force of the first wire W1 which connects the first shaft 123 and the pad assembly 2 may be control to be increased or reduced by winding the first wire W1 on or releasing the first wire W1 from the tension control device 127. The tension control device 127 may be provided so that the first wire W1 extends and connects along a minimum distance route between the first shaft 123 and the pad assembly 2, or that the first wire W1 is pulled and thus detours and connects around the minimum distance route between the first shaft 123 and the pad assembly 2.

The second wire W2 may also be connected with a tension control device (not shown) so that a tensile force thereof is controlled. The tension control device (not shown) connected to the second wire W2 may have a configuration similar to the tension control device 127 connected to the first wire W1.

Since the pad assembly 2 may be connected to the motor through the wires W1 and W2 to be tilted, a smaller torque than when being connected by a link frame may be applied to the motor. When the pad assembly and the motor are connected by the link frame, the motor may generate an output having a torque value obtained by multiplying a length of the link by a magnitude of force applied to the pad assembly. However, when the pad assembly and the motor are connected by the wire, the motor may only need to generate an output having a torque value obtained by multiplying a diameter of the shaft on which the wire is wound by the magnitude of the force applied to the pad assembly. It may be expected that the diameter of the shaft on which the wire is wound will be much smaller than the length of the link. Therefore, when the pad assembly and the motor are connected by the wire, it may be possible to use a motor having a small output, and thus it may be possible to reduce manufacturing costs of the robot cleaner 1. Further, when using the wire, it may be possible to reduce a volume of the robot cleaner 1 compared to a robot cleaner using the link. Accordingly, the robot cleaner 1 may have a smaller size.

Figure 5A:
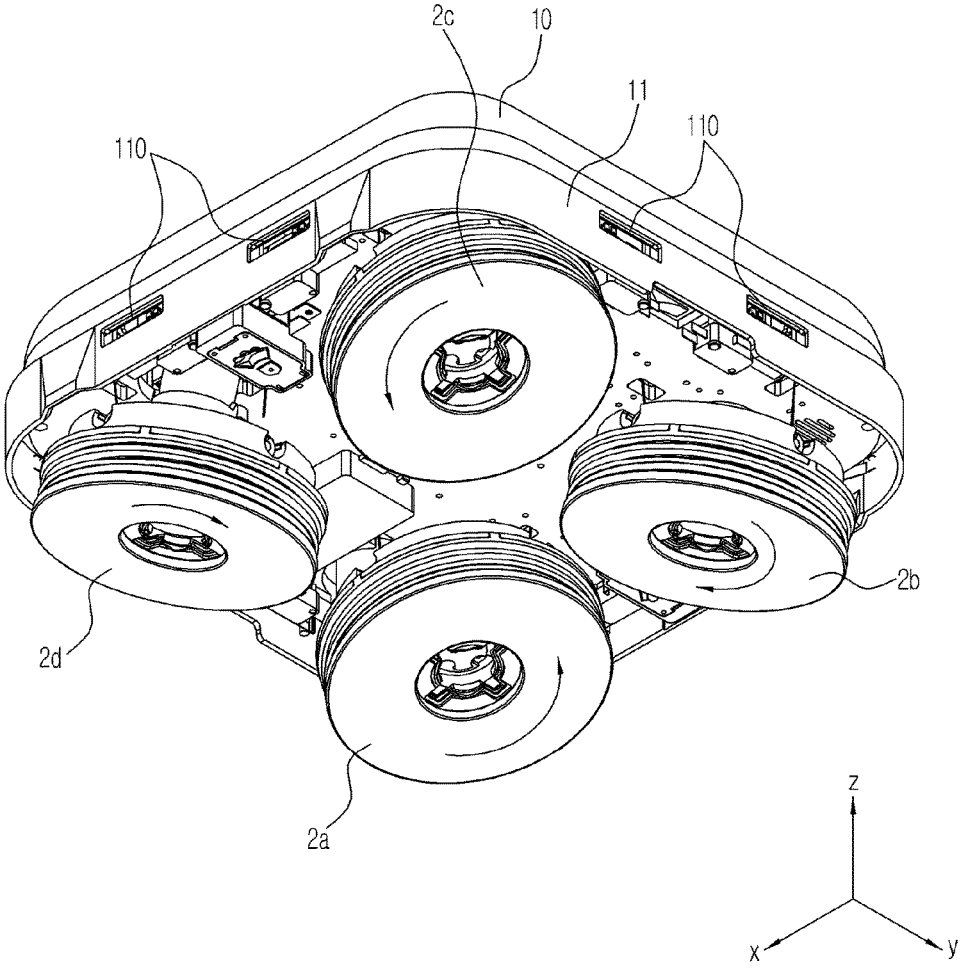
FIGS. 5A and 5B are views respectively illustrating a state in which a robot cleaner moves forward in accordance with one or more embodiment.
Figure 5B:
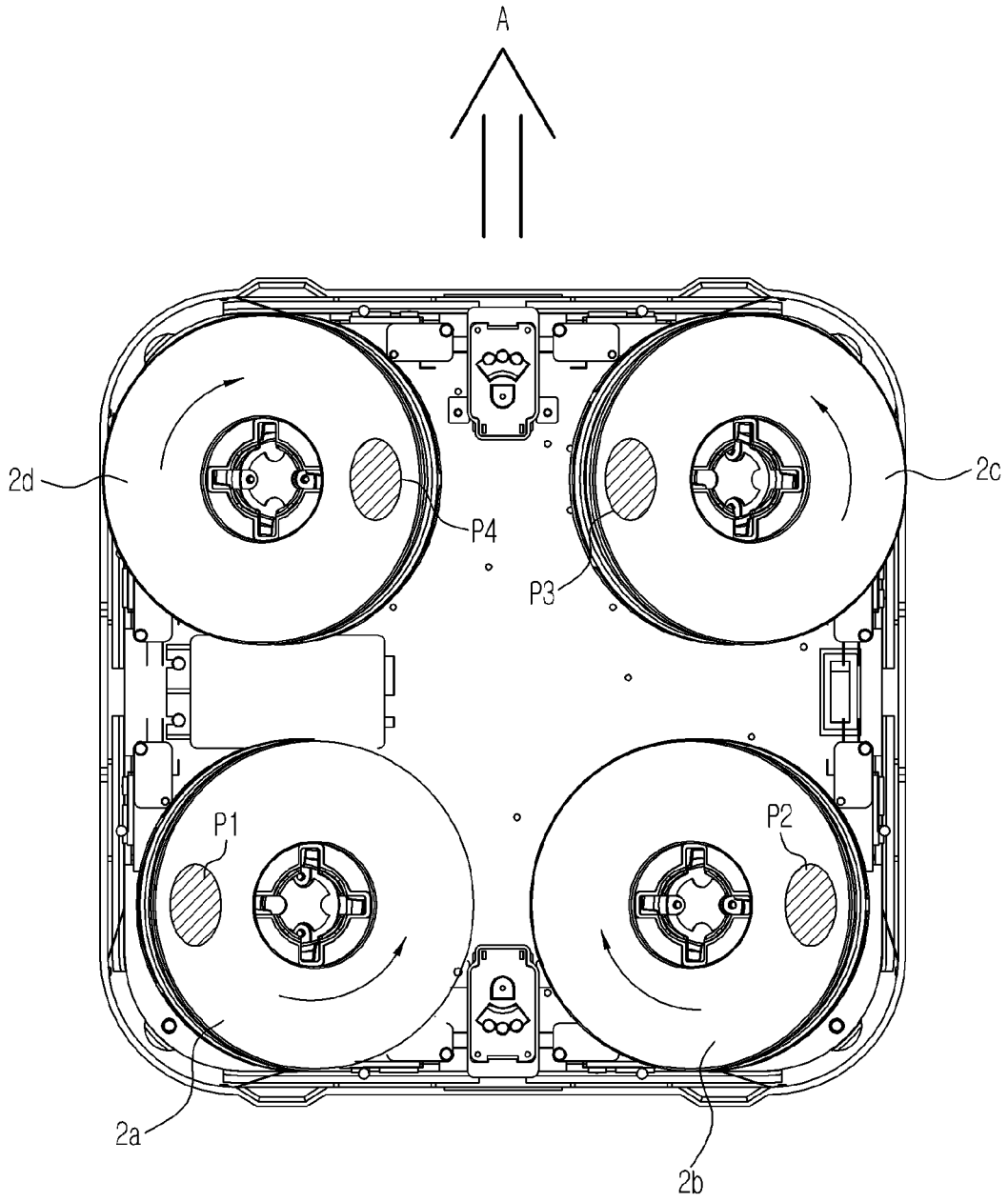
Figure 6A:
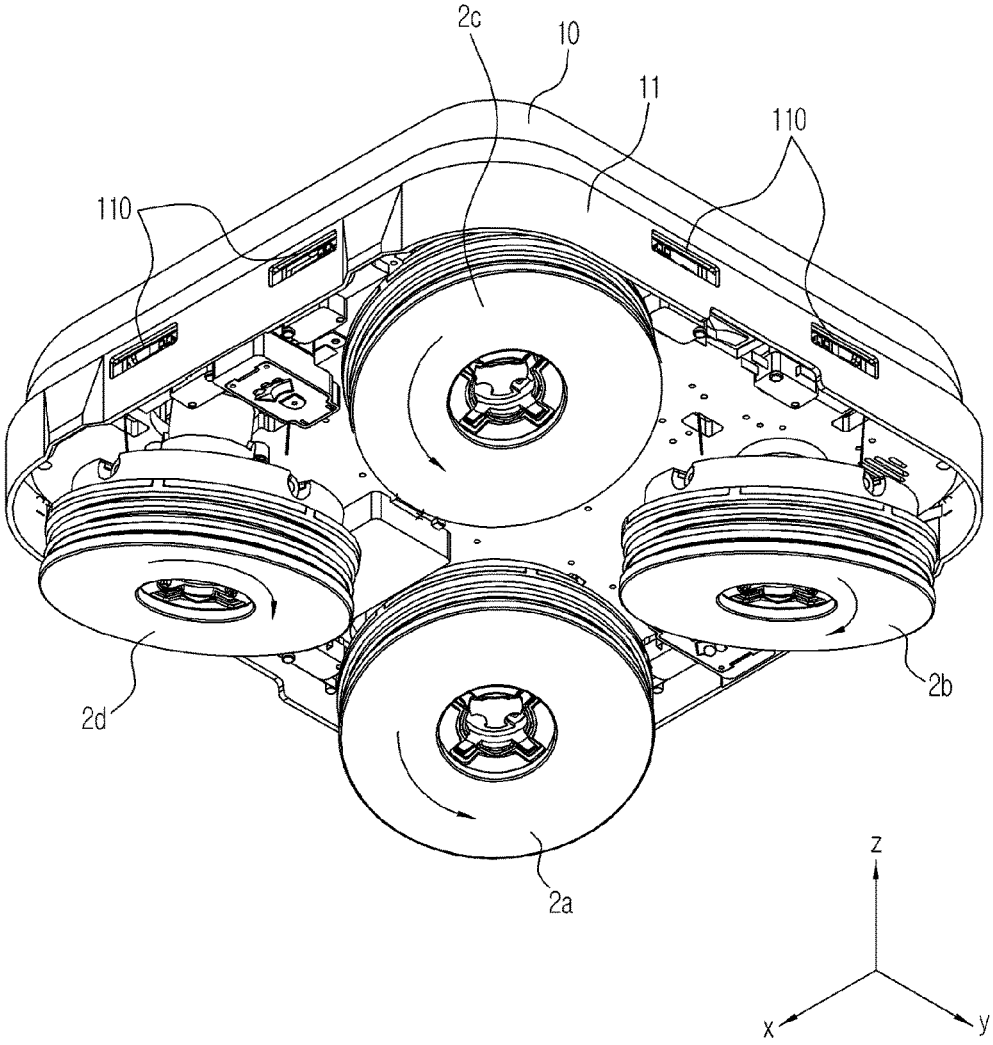
FIGS. 6A and 6B are views respectively illustrating a state in which a robot cleaner moves diagonally in accordance with one or more embodiment.
Figure 6B:
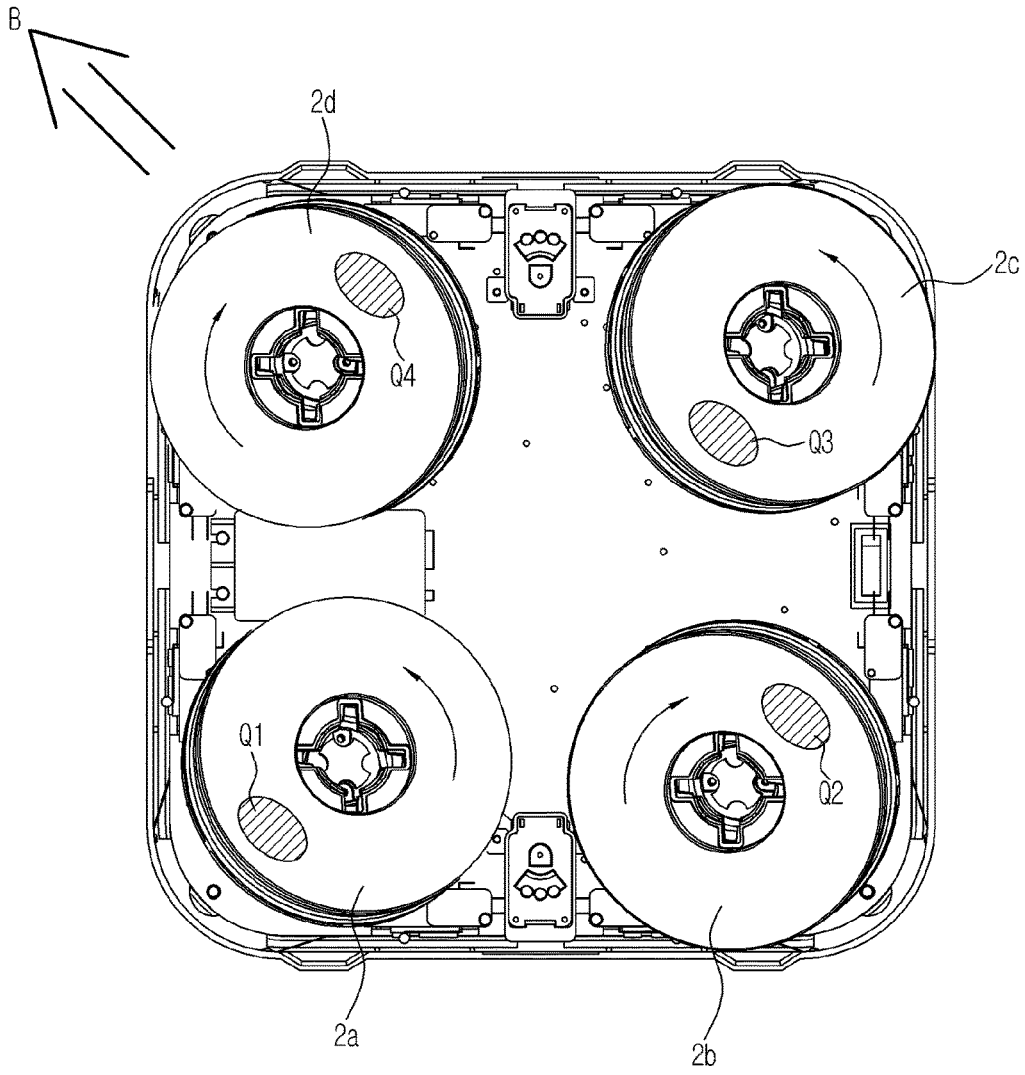

FIGS. 5A and 5B are views respectively illustrating a state in which the robot cleaner moves forward in accordance with one or more embodiment, and FIGS. 6A and 6B are views respectively illustrating a state in which the robot cleaner moves diagonally in accordance with one or more embodiment.

Referring to FIGS. 5A to 6B, the robot cleaner 1 in accordance with one or more embodiment may move in a particular direction by the non-uniform frictional force between the pad assembly 2 and the floor surface. Specifically, the robot cleaner 1 may move in a direction having a large frictional force between the bottom surface of the pad assembly 2 and the floor surface. A driving speed of the robot cleaner 1 may be varied by a rotational speed of the third motor 122.

As an example, the first pad assembly 2*a* may be tilted with respect to the x-axis so that a portion P1 has the greatest frictional force with the floor surface, and may also be rotated around the z-axis in the counterclockwise direction. The second pad assembly 2*b* may be tilted with respect to the x-axis so that a portion P2 has the greatest frictional force with the floor surface, and may also be rotated around the z-axis in the clockwise direction. The third pad assembly 2*c* may be tilted with respect to the x-axis so that a portion P3 has the greatest frictional force with the floor surface, and may also be rotated around the z-axis in the counterclockwise direction. The fourth pad assembly 2*d* may be tilted with respect to the x-axis so that a portion P4 has the greatest frictional force with the floor surface, and may also be rotated around the z-axis in the clockwise direction. In this case, as illustrated in FIGS. 5A and 5B, the robot cleaner 1 may move in a direction A (a forward direction).

As another example, the first pad assembly 2*a* may be tilted with respect to the x-axis and the y-axis so that a portion Q1 has the greatest frictional force with the floor surface, and may also be rotated around the z-axis in the counterclockwise direction. The second pad assembly 2*b* may be tilted with respect to the x-axis and the y-axis so that a portion Q2 has the greatest frictional force with the floor surface, and may also be rotated around the z-axis in the clockwise direction. The third pad assembly 2*c* may be tilted with respect to the x-axis and the y-axis so that a portion Q3 has the greatest frictional force with the floor surface, and may also be rotated around the z-axis in the counterclockwise direction. The fourth pad assembly 2*d* may be tilted with respect to the x-axis and the y-axis so that a portion Q4 has the greatest frictional force with the floor surface, and may also be rotated around the z-axis in the clockwise direction. In this case, as illustrated in FIGS. 6A and 6B, the robot cleaner 1 may move in a direction B (a diagonal direction).

Figure 7:
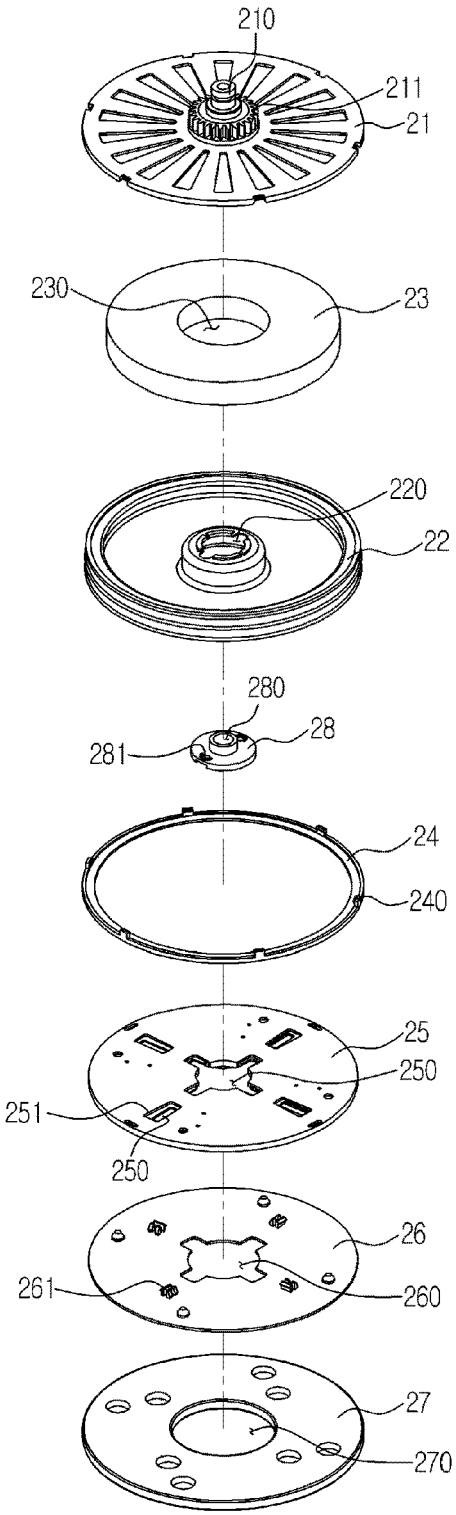
FIG. 7 is an exploded perspective view of a pad assembly of a robot cleaner in accordance with one or more embodiment.

FIG. 7 is an exploded perspective view of the pad assembly of the robot cleaner in accordance with one or more embodiment.

Referring to FIGS. 3, 4, and 7, the pad assembly 2 of the robot cleaner 1 in accordance with one or more embodiment may include an installation part 20 which may be installed at the base 12, a rotational plate 21 which may be rotatably connected to the installation part 20, an elastic member assembly 22, 23, 24, a locking part 25, a pad unit 26, 27 and a water supplying member 28.

The installation part 20 is installed at the base 12. The rotational plate 21 may be rotatably installed at a bottom surface of the installation part 20 via a ball joint. The first and second wires W1 and W2 may be installed at the installation part 20. The installation part 20 may include a first wire installation part 203, 205 at which the first wire W1 may be installed and a second wire installation part 202, 204 at which the second wire W2 may be installed. When seeing the installation part 20 from an upper side, the first wire W1 and the second wire W2 may be provided to intersect with each other. For example, the first wire installation part 203, 205 and the second wire installation part 202, 204 may be alternately disposed. That is, the first wire installation part 203, the second wire installation part 202, the first wire installation part 205, and the second wire installation part 204 may be disposed in turn along an outer circumferential surface of the installation part 20 in the clockwise direction.

The third motor 122 may be installed at the installation part 20. The third motor 122 may be connected with a driving gear 206. The driving gear 206 may be engaged with a gear 211 provided at the rotational plate 21 to transmit a driving force of the third motor 122 to the rotational plate 21. The driving gear 206 may be provided in the installation part 20.

The rotational plate 21 may be freely rotatably disposed at the installation part 20 via the ball joint. A connection part 210 which may be in communication with the water supplying tube (not shown) connected with the water tank 101 may be provided at the rotational plate 21. The water stored in the water tank 101 may be supplied to the connection part 210 via the water supplying tube (not shown). The gear 211 may be provided at the connection part 210 to be connected with the third motor 122. The gear 211 may be engaged with the driving gear 206 in the installation part 20. When the third motor 122 is driven, the gear 211 may be engaged with the driving gear 206 and rotated. Therefore, the rotational plate 21 may be rotated around the z-axis in the clockwise or counterclockwise direction.

The elastic member assembly 22, 23, 24 may be provided at a bottom surface of the rotational plate 21. The elastic member assembly 22, 23, 24 may include an elastic member receiving part 22, an elastic body 23, and a fixing member 24. The elastic member receiving part 22 may be formed as a flexible tube having a plurality of wrinkles. The elastic member receiving part 22 may be formed of a water-resistant rubber material.

The elastic body 23 may be received in the elastic member receiving part 22. The elastic body 23 may be formed of a material such as a sponge. The entire bottom surface of the pad assembly 2 may be kept in contact with the floor surface by the elastic body 23. That is, even when the pad assembly 2 is tilted, the entire bottom surface of the pad assembly 2 may be in contact with the floor surface by the elastic body 23. However, the frictional force between the pad assembly 2 and the floor surface may be non-uniform. Since the elastic body 23 is received in the elastic member receiving part 22, the water supplied through the connection part 210 may not permeate into the elastic body 23.

The fixing member 24 may install the elastic member receiving part 22 at the rotational plate 21. The fixing member 24 may have a fixing part 240. In a state in which an upper end of the elastic member receiving part 22 is located between the rotational plate 21 and the fixing member 24, the fixing member 24 may be coupled to the rotational plate 21, and thus the elastic member receiving part 22 may be installed at the rotational plate 21. For example, the fixing member 24 and the rotational plate 21 may be coupled with each other in a hook manner.

The locking part 25 may be installed at a bottom surface of the elastic member assembly 22, 23, 24. A pad installation part 26 may be removably disposed at a bottom surface of the locking part 25. The pad installation part 26 may have an interference protrusion 261, and the locking part 25 may have a locking member 251 which may interfere with the interference protrusion 261. The locking member 251 may be provided to interfere with a part of a locking hole 250 formed in the locking part 25. If the interference protrusion 261 may pass through the locking hole 250, the interference protrusion 261 may be interfered with by the locking member 251 and thus may be fixed therein so as not to get out of the locking hole 250. Therefore, the pad installation part 26 may be installed at the locking part 25.

A pad 27 which cleans the floor surface may be installed at a bottom surface of the pad installation part 26. The pad 27 may be removably installed at the pad installation part 26 in a Velcro manner or the like.

Each of the elastic member assembly 22, 23, 24, the locking part 25, the pad installation part 26, and the pad 27 may be formed to be in communication with water supplying holes 220, 230, 250, 260, and 270 through which the water supplied from the connection part 210 of the rotational plate 21 may flow. The water supplying member 28 may be provided under the rotational plate 21. A central hole 280 in communication with the connection part 210 may be formed in a central portion of the water supplying member 28. A side hole 281 in communication with the central hole 280 may be formed at a side surface of the water supplying member 28. A plurality of side holes 281 may be provided in regular intervals. The water supplied to the water supplying member 28 through the central hole 280 may be sprayed through the side hole 281 formed at the side surface of the water supplying member 28. The water sprayed through the side hole 281 may be supplied to the pad 27 through the water supplying holes 220, 230, 250, 260, and 270. The pad 27 may receive the water and wet-clean the floor surface.

According to one or more embodiment, it is possible to miniaturize the robot cleaner. Since it is possible to use the motor which generates an output having a small torque, the manufacturing costs may be reduced. Further, the elastic member provided at the pad assembly may be maintained sanitarily.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A robot cleaner comprising:

a first motor;

a pad assembly including a rotatable portion of the pad assembly coupled to the first motor to receive a rotational force from the first motor and configured to rotate in a clockwise direction or a counterclockwise direction so that when the robot cleaner is positioned on a surface to be cleaned, a bottom surface of the rotatable portion of the pad assembly contacting the surface to be cleaned; and a second motor;

a first shaft connected to the second motor, the first shaft including a first driving shaft connected with the second motor, and a first connection shaft geared with the first driving shaft; and a first wire connected to the pad assembly and the first shaft, the first wire including a first portion configured to connect the first driving shaft of the first shaft and one side of the pad assembly, and a second portion configured to connect the first connection shaft of the first shaft and another side of the pad assembly that is opposite to the one side the pad assembly, so that at least a portion of the rotatable pad assembly is tilted by a movement of the first wire by a driving force of the second motor so when the robot cleaner is positioned on the surface to be cleaned the bottom surface of the titled rotatable portion of the pad assembly applies a non-uniform frictional force with respect to the surface to be cleaned and the robot cleaner moves in a particular direction by the non-uniform frictional force between the bottom surface of the rotatable portion of the pad assembly and the surface to be cleaned.

2. The robot cleaner according to claim 1, further comprising a second wire connected to the pad assembly so that at least a portion of the pad assembly is tiltable with respect to a y-axis by a movement of the second wire, and wherein the pad assembly is tiltable with respect to an x-axis by the movement of the first wire, and wherein the pad assembly is tiltable by an individual movement of the first wire or second wire, or a combination of the movement of the first wire and the movement of the second wire.

3. The robot cleaner according to claim 2, further comprising:

a third motor and at least a portion of the rotatable pad assembly is tilted with respect to the y-axis by a movement of the second wire by a driving force of the third motor.

4. The robot cleaner according to claim 3, wherein the second wire is installed at a second shaft connected to the third motor to be rotated.

5. The robot cleaner according to claim 3, wherein the pad assembly comprises a rotational plate rotatable in the clockwise or the counterclockwise direction by the first motor.

6. The robot cleaner according to claim 5, wherein the pad assembly comprises:

an elastic member assembly installed at a bottom surface of the rotational plate; and a pad unit installed at a bottom surface of the elastic member assembly.

7. The robot cleaner according to claim 6, wherein the elastic member assembly comprises:

an elastic body configured to adapt an entire bottom surface of the pad assembly to be in contact with the floor surface; and an elastic member receiving part in which the elastic body is received.

8. The robot cleaner according to claim 7, wherein the elastic member receiving part is formed as a flexible tube having a plurality of wrinkles and formed of a rubber material.

9. The robot cleaner according to claim 7, wherein the pad unit comprises;

a pad installation part removably installed at a bottom surface of the elastic member receiving part; and a pad removably installed at the pad installation part to clean the floor surface.

10. The robot cleaner according to claim 6, wherein the rotational plate has a connection part through which water is suppliable from a water tank, and the elastic member assembly and the pad unit have a water supplying hole in communication with the connection part.

11. The robot cleaner according to claim 10, wherein a water supplying member is installed at the rotational plate, and the water supplying member comprises a central hole in communication with the connection part and a side hole formed at a side surface thereof to be in communication with the central hole.

12. The robot cleaner according to claim 11, wherein the water supplied through the connection part is sprayed through the side hole of the water supplying member.

13. The robot cleaner according to claim 1, wherein the pad assembly is provided in plural, and each pad assembly is driven independently.

14. A robot cleaner comprising:

a pad assembly installed at a base of the robot cleaner and having a rotatable pad installed at a bottom surface thereof;

a first motor coupled with the pad assembly to rotate at least a portion of the pad assembly in a clockwise direction or a counterclockwise direction;

a second motor and a third motor which are provided at the base of the robot cleaner;

a first shaft connected to the second motor, the first shaft including a first driving shaft connected with the second motor, and a first connection shaft geared with the first driving shaft;

a first wire connected with the pad assembly and the first shaft to tilt at least a portion of the pad assembly with respect to an x-axis, the first wire including a first portion configured to connect the first driving shaft and one side of the pad assembly, and a second portion configured to connect the first connection shaft and another side of the pad assembly that is opposite to the one side the pad assembly; and a second wire connected with the pad assembly and the third motor to tilt at least the portion of the pad assembly with respect to a y-axis, wherein, when the robot cleaner is positioned on the surface and the at least the portion of the pad assembly is tilted by one of the first wire and the second wire or by a combination of the first wire and the second wire, the robot cleaner moves in a particular direction by a non-uniform frictional force between the bottom surface of the tilted rotatable pad and the surface.

15. The robot cleaner according to claim 14, wherein a moving direction is determined by a position having a large frictional force between the bottom surface of the pad assembly and the floor surface and a rotational direction by the first motor.

16. The robot cleaner according to claim 14, wherein the third motor includes a second shaft and the second wire is installed at the second shaft connected to the third motor to be rotated.

17. The robot cleaner according to claim 14, wherein the pad assembly comprises an elastic body configured to adapt an entire surface of the pad to be in contact with the floor surface.

18. A robot cleaner comprising:

a pad assembly installed at a base of the robot cleaner and having a rotatable pad installed at a bottom surface thereof;

a first motor coupled with the pad assembly to rotate at least a portion of the pad assembly in a clockwise direction or a counterclockwise direction;

a second motor and a third motor which are provided at the base of the robot cleaner;

a first wire connected with the pad assembly and the second motor to tilt at least a portion of the pad assembly with respect to an x-axis; and a second wire connected with the pad assembly and the third motor to tilt at least the portion of the pad assembly with respect to a y-axis, wherein, when the robot cleaner is positioned on a surface and the at least the portion of the pad assembly is tilted by one of the first wire and the second wire or by a combination of the first wire and the second wire, the robot cleaner moves in a particular direction by a non-uniform frictional force between the bottom surface of the tilted rotatable pad and the surface, wherein the pad assembly comprises an elastic body configured to adapt an entire surface of the pad to be in contact with the surface, and wherein the elastic body is received in a flexible tube having a plurality of wrinkles and formed of a rubber material.

19. A robot cleaner comprising:

a first motor;

a pad assembly including at least a rotatable portion of the pad assembly connected to the first motor by a rotational plate to receive a rotational force from the first motor and configured to rotate in a clockwise direction or a counterclockwise direction so that when the robot cleaner is positioned on a surface to be cleaned, a bottom surface of the rotatable portion of the pad assembly contacting the surface to be cleaned;

a water supplying member installed at the rotational plate, the water supplying member comprising a central hole in communication with a water tank and a side hole formed at a side surface thereof to be in communication with the central hole; and a second motor;

a first shaft connected to the second motor, the first shaft including a first driving shaft connected with the second motor, and a first connection shaft geared with the first driving shaft; and a first wire connected to the pad assembly and the first shaft, the first wire including a first portion configured to connect the first driving shaft of the first shaft and one side of the pad assembly, and a second portion configured to connect the first connection shaft of the first shaft and another side of the pad assembly that is opposite to the one side the pad assembly, so that at least a portion of the rotatable pad assembly is tilted by a movement of the first wire and the least a portion of the pad assembly is tiltable by the movement of the first wire by the driving force of the second motor so when the robot cleaner is positioned on the surface to be cleaned, the bottom surface of the titled rotatable portion of the pad assembly applies a non-uniform frictional force with respect to the surface to be cleaned.

20. The robot cleaner according to claim 19, further comprising a second wire connected to the pad assembly and a third motor so that the pad assembly is tiltable by a movement of the second wire by the driving force of the third motor, wherein the pad assembly tiltable with respect to an x-axis by the movement of the first wire, the pad assembly is tiltable with respect to a y-axis by the movement of the second wire, wherein the pad assembly is tiltable by an individual movement of the first wire or second wire, or a combination of the movement of the first wire and the movement of the second wire.

21. A robot cleaner comprising:

a first motor;

a pad assembly comprising a rotational plate rotatable in a clockwise direction or a counterclockwise direction by the first motor to clean a surface with a bottom surface of a pad attachable to the rotational plate assembly contacting the surface to be cleaned;

a water supplying member installed at the rotational plate, the water supplying member comprising a central hole in communication with a water tank and a side hole formed at a side surface thereof to be in communication with the central hole;

a second motor;

a first shaft connected to the second motor, the first shaft including a first driving shaft connected with the second motor, and a first connection shaft geared with the first driving shaft; and a first wire connected to the pad assembly and the second motor, the first wire including a first portion configured to connect the first driving shaft and one side of the pad assembly, and a second portion configured to connect the first connection shaft and another side of the pad assembly that is opposite to the one side the pad assembly, so that at least a portion of the pad assembly is tiltable by a movement of the first wire by a driving force of the second motor so when the robot cleaner is positioned on the surface to be cleaned and titled by the movement of the first wire, the bottom surface of the tilted rotational plate of the pad assembly applies a non-uniform frictional force with respect to the surface to be cleaned, and the robot cleaner is movable in a particular direction by the non-uniform frictional force between the bottom surface of the rotational plate of the pad assembly and the surface to be cleaned.

* * * * *